US006077590A

United States Patent [19]

Archer et al.

[11] Patent Number: 6,077,590

[45] Date of Patent: Jun. 20, 2000

[54] HIGH BULK PAPER TOWELS

[75] Inventors: Sammy Lee Archer, Lynnwood, Wash.; Eric John Draheim; Thomas Garrett Neal, Jr., both of Appleton, Wis.; Jerome Steven Veith, Menasha, Wis.; Mary Martha Zielinski, Neenah, Wis.

[73] Assignee: Kimberly-Clark Worldwide, Inc., Neenah, Wis.

[21] Appl. No.: 09/060,485

[22] Filed: Apr. 15, 1998

[51] Int. Cl.[7] ..... D06N 7/04

[52] U.S. Cl. ..... 428/153; 428/141; 428/154; 428/537.5; 162/109; 162/111; 162/113

[58] Field of Search ..... 428/141, 153, 428/154, 537.5; 162/109, 111, 113

[56] References Cited

U.S. PATENT DOCUMENTS

| | | | |
|---|---|---|---|
| 4,921,034 | 5/1990 | Burgess et al. | 162/109 |
| 4,992,140 | 2/1991 | Anderson et al. | 162/111 |
| 5,356,364 | 10/1994 | Veith et al. | 493/395 |
| 5,409,572 | 4/1995 | Kershaw et al. | 162/109 |
| 5,503,896 | 4/1996 | Veith et al. | 428/141 |
| 5,529,563 | 6/1996 | Veith et al. | 493/395 |
| 5,693,403 | 12/1997 | Brown et al. | 428/153 |
| 5,851,353 | 12/1998 | Fiscus et al. | 162/113 |

FOREIGN PATENT DOCUMENTS 0 428 136 A1 5/1991 European Pat. Off. .

OTHER PUBLICATIONS

Patent Cooperation Treaty Search Report from the International Search Authority, International Application No. PCT/US 99/07685 dated Jul. 5, 1999.

*Primary Examiner*—William Krynski
*Assistant Examiner*—B. Shewareged
*Attorney, Agent, or Firm*—Gregory E. Croft

[57] ABSTRACT

Rolled creped paper products, such as kitchen towels, can be provided with high roll bulk and a high degree of roll firmness by steaming the dry, creped paper sheet immediately prior to embossing the sheet between matched steel embossing rolls. The steaming preconditions the sheet such that the resulting sheet embossments maintain their shape and structural strength, thereby imparting greater bulk and firmness to the wound roll of product. In addition, the sheet experiences less cross-machine strength reduction as a consequence of the embossing.

19 Claims, 4 Drawing Sheets

HIGH BULK PAPER TOWELS

BACKGROUND OF THE INVENTION

In the manufacture and production of rolled paper towels, such as kitchen towels, a creped base sheet is commonly produced on a tissue machine and wound into a parent roll. Thereafter, in converting operations, the parent roll is unwound and embossed in order to increase the bulk of the towel. The designs of the embossing patterns can vary greatly, but often they are embossing patterns which substantially cover the entire sheet and may be referred to as overall patterns. However, a common problem associated with embossing towel base sheets is that, upon being wound into the final roll form of the product, the sheet embossments cause the roll to be somewhat soft and "mushy". This effect, which can be quantified by measuring the roll firmness, becomes more pronounced as the bulk of the roll is increased by imparting embossments to the base sheet which have greater z-direction dimensions. At the same time, increasing the bulk of the base sheet also typically degrades the strength of the sheet.

Therefore there is a need for a means of producing rolls of embossed, creped paper towels having a high roll bulk and a high degree of roll firmness with adequate strength.

SUMMARY OF THE INVENTION

It has now been discovered that rolls of creped paper towels can be made to have a high level of bulk, firmness and strength by embossing the creped basesheet in a manner which maintains more of the basesheet strength during the embossing process.

Hence, in one aspect, the invention resides in a method of making a high bulk paper sheet comprising spraying a dry, creped paper sheet with steam and immediately thereafter embossing the steamed sheet between matched steel embossing rolls. It has been found that steaming the sheet just prior to embossing can increase the roll firmness (as compared to the unsteamed embossed sheet) about 15 percent or greater, more specifically from about 20 to about 50 percent, and still more specifically from about 20 to about 35 percent. As will be discussed below, "increasing" the roll firmness results in a lowering of the roll firmness value, which is measured by the extent to which a probe penetrates the roll during testing. Furthermore, steaming in accordance with this invention can increase the strength of the sheet, as measured by the cross-machine direction (CD) tensile strength, about 10 percent or greater, more specifically from about 10 to about 30 percent, and still more specifically from about 10 to about 20 percent (as compared to the unsteamed embossed sheet).

In another aspect, the invention resides in a roll of creped paper, such as a roll of kitchen toweling, having a roll bulk of about 13 cubic centimeters per gram (cc/g) or greater, a roll firmness of 10 millimeters (mm) or less and a CD tensile strength of about 2000 or greater grams-force per 3 inches of sample width (grams).

More specifically with regard to the roll bulk, the roll bulk can be about 15 cc/g or greater, more specifically about 16 cc/g or greater, still more specifically from about 14 cc/g to about 20 cc/g, and still more specifically from about 15 cc/g to about 17 cc/g.

More specifically with regard to the roll firmness, the roll firmness can be about 9 mm or less, still more specifically from about 6 to about 10, and most specifically from about 7 to about 9.

More specifically with regard to the CD tensile strength, the CD tensile strength can be about 2500 grams or greater, more specifically from about 2200 to about 3500 grams, and still more specifically from about 2300 to about 3200 grams.

DETAILED DESCRIPTION OF THE DRAWINGS

Figure 1:
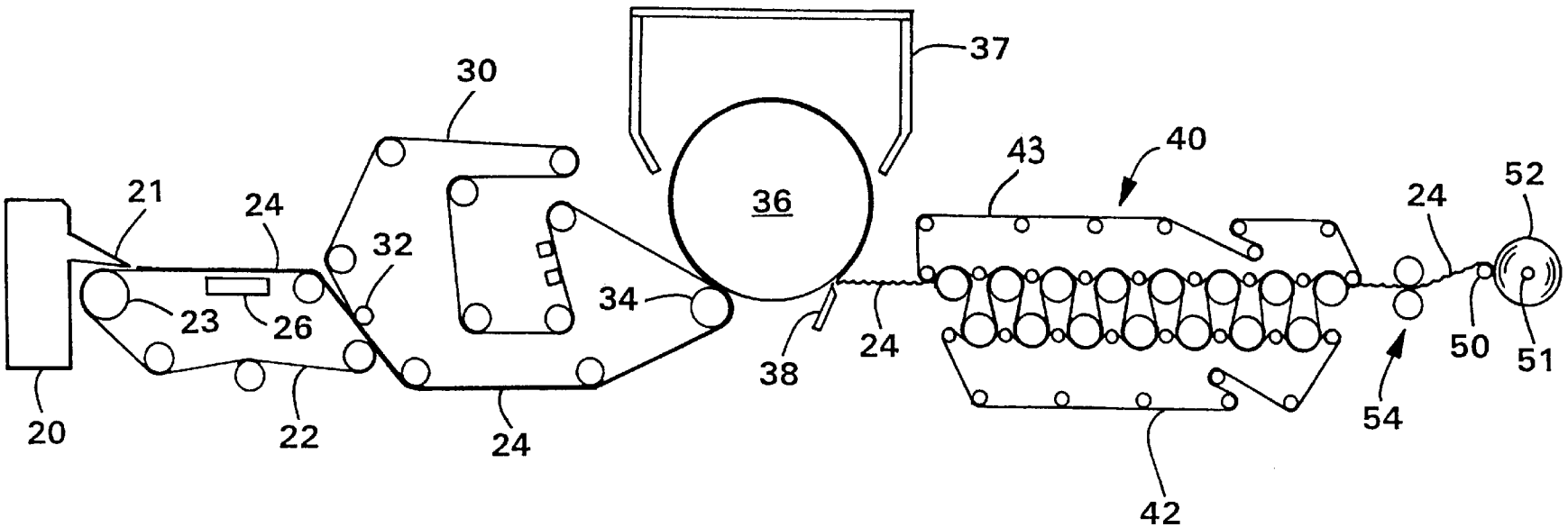
FIG. 1 is a schematic process diagram illustrating a method for making the creped base sheets suitable for purposes of the embossing method of this invention.

Referring to FIG. 11 one example of a method of making a creped base sheet suitable for subsequent steaming and embossing is disclosed. Shown is a schematic of the preferred embodiment of the present invention wherein a head box 20 delivers a furnish 21 onto a forming fabric 22 wrapped around a vacuum breast roll 23. The furnish preferably is at a fiber consistency of from about 0.08% to about 0.6% and, more preferably, at a fiber consistency of from about 0.1% to about 0.5%, and most preferably at a fiber consistency of from about 0.1% to about 0.2%. Immediately after the vacuum breast roll 23, forming fabric 22 passes over the vacuum box 26 to further dewater the web 24.

It should be noted that the type of headbox used is not critical to the practice of the method of the present invention. Any headbox which delivers a well-formed sheet may be employed. Further, although the embodiments discussed herein and depicted in FIG. 1 utilizes a vacuum breast roll, this too is not critical to the practice of the method of the present invention. The method may be used with breast roll formers, twin wire formers and fourdriniers, as well as variations thereof.

The web and the forming fabric then pass through a transfer zone wherein the web 24 is transferred to a felt 30. The transfer is made with a pickup device 32 such as a vacuum pick-up roll or transfer shoe. The felt 30 carries the web to the nip formed between a vacuum press roll 34 and a Yankee dryer 36 where the vacuum press roll is used to press the felt against the Yankee with the web restrained therebetween. The amount of pressing of the press roll against the Yankee can be in the range of 200–500 pli. In the nip, the web 24 releases from the felt 30 and is adhered to the Yankee. Creping adhesives and release chemicals can be sprayed onto the Yankee just prior to the vacuum press roll to control the amount of adhesion of the web to the Yankee. When the web leaves the vacuum press roll/Yankee nip, the web has a consistency of about 30% or greater, more preferably greater than 35% and most preferably 38% to 43%. The web is at least partially dried on the Yankee and drying may be aided by the use of a gas-fired high temperature hood 37. A moisturizing spray to the air side of the tissue web may be added as illustrated in U.S. Pat. No. 4,992,140 issued Feb. 12, 1991 to Anderson et al. entitled "Method For Creping A Paper Web and Product Produced Thereby", which is hereby incorporated by reference. The web just prior to the creping doctor 38 should have a dryness of from about 40 to about 99 percent, more preferably from about 45 to about 65 percent.

After the leaving the Yankee the partially dried web 24 is subsequently transferred to a can drying assembly 40 specifically configured to maintain or increase the bulk of the web and to remove moisture and dry the web. The can drying assembly 40 comprises a plurality of can dryers. The exact number of can dryers may vary depending on the desired increase in dryness of the web 24, machine speed, basis weight, and similar factors.

The web 24 is transported across an open draw from the creping doctor 38 to the can drying assembly and is sandwiched between the sheet carrying fabrics (felts) 42 and 43. The web 24 is dried to a final consistency of about 94 percent or greater in the can drying assembly and is thereafter transported to a reel 50 and a reel spool 51 where the web is wound onto the reel spool to form a roll 52 for subsequent conversion into the final product form. Prior to being wound onto the reel spool, the web 24 can be carried through one or more optional fixed gap embossing or calendering nips 54.

It is emphasized that the manner in which the basesheet is made is not significant for the practice of Applicants invention. Any creped web or sheet can be used. The foregoing process description is merely illustrative of one suitable method.

Figure 2A:
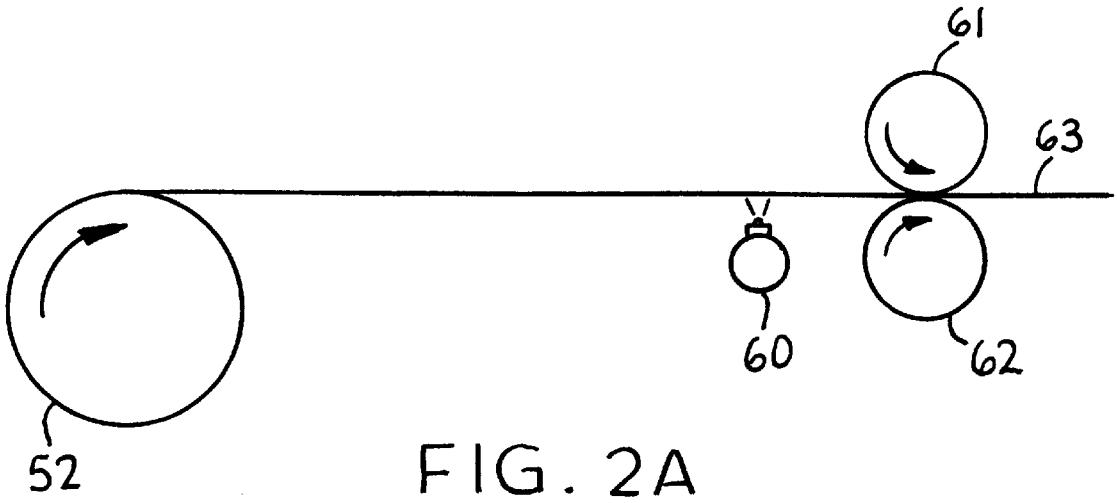
FIG. 2A is a schematic process flow diagram of the off-line steaming and embossing aspects of this invention.

FIG. 2A illustrates the off line steaming and embossing method of this invention. Shown is a parent roll 52 of creped base sheet being unwound and passed over a steam boom 60 prior to being embossed between matched steel embossing rolls 61 and 62. The resulting embossed sheet 63 is then wound into rolls as needed for subsequent converting to the final rolled product.

Figure 2B:
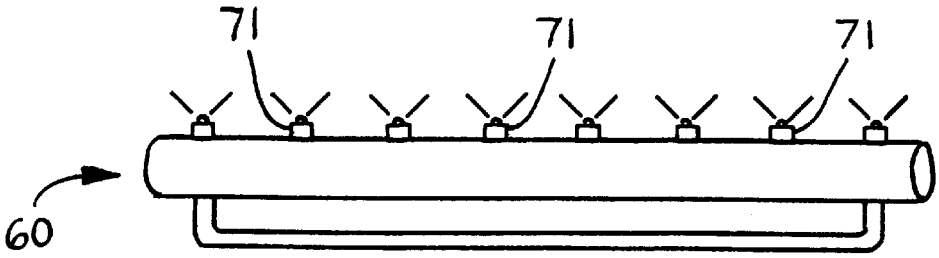
FIG. 2B is a schematic representation of the steam application boom illustrated in FIG. 2A.

FIG. 2B illustrates a specific design of the steam application boom. Although not shown, the steam system supply piping is designed to supply high quality steam to the steam application boom. Target steam pressure at the boom is preferably between 5 and 10 psi. The number and size of valves, traps and filters between the steam header and steam application boom control the pressure drop within the piping system. Ideally, the supply pressure is high enough that the pressure at the application boom can be controlled to a range which encompasses the target pressure.

In a specific embodiment, the steam supply should come off of a header with 30 to 50 lbs of steam pressure. A pressure gauge is located on the downleg of the steam header which allows for verification of header pressure. After the pressure gauge, there is a globe or gate valve which allows for shutting off the steam flow in order to work on the system. Next, there is steam filter which removes dirt from the steam. The filter should feed either tubing or pipe which leads to a drain. Past the filter there is a solenoid valve, a steam trap, and a gate valve. The solenoid valve opens and closes as the converting equipment starts and stops. The steam trap is in place to allow condensation, which builds up while the equipment is down, to be removed from the steam. The gate valve is in place to allow for steam to flow through the system to the drain for condensate removal purposes after extended shutdowns. Beyond the solenoid valve, piping leads to the steam application boom. A pressure regulating valve may be placed between the application boom and the solenoid valve if desired. The pressure regulator dampens any swings in the header pressure and provides a control knob for steam pressure at the application boom. If a pressure regulating valve is not installed, the shut off valve can be used for pressure regulation at the steam application boom. A flexible hose between the piping and the application boom allows for rotational and positional adjustment of the application boom. A piece of tubing comes off of the application boom and is routed to the drain. A valve is installed in the tubing to allow for controllable steam flow through the tubing to the drain in order to remove condensate from the application boom piping.

The steam application boom is constructed out of a stainless steel pipe between one and two inches in diameter (ID). The pipe is capped on one or both ends depending on where steam is fed into the pipe. Steam can be fed to the pipe from the middle or the end, whichever is most convenient. A pressure equalization pipe can be attached to the bottom side of one end of the boom and run the length of the boom for attachment at the opposite end of the boom as illustrated in FIG. 2B. This configuration allows for more equal pressure along the length of the application boom. One end of the steam application pipe is fitted with a steam pressure gauge to measure the pressure in the boom. Steam flow out of the boom is dependent on the open area of the nozzles 71 and the steam pressure at the boom. A preferred embodiment has nozzles placed every three inches along the length of the application boom. Size Q, R, U, or V blow off nozzles from Spraying Systems Co., Wheaton, Ill. have been used. The fan of the nozzle is oriented such that it results in maximum coverage of the sheet. The appropriate combination of the number of nozzles and spray tip size should be chosen so that sufficient steam pressure is available in the boom to apply steam at the rate of from about 0.3 to about 2.0 lb. steam/3000 sq. ft. of paper, more specifically at a rate of from about 0.8 to about 1.5 lb. steam/3000 sq. ft. of paper, and still more specifically at a rate of about 1 lb steam/3000 $ft^2$ of paper.

The steam application boom should be positioned under the sheet so that any condensation does not drip onto the moving sheet and cause a break. The steam is applied to the sheet from about 6 to about 18 inches upstream of the embossing rolls. At the speeds associated with converting lines, this provides that the embossing will follow the steaming within less than a second or two. Preferably, the sheet will ride from about one to about two inches above the steam spray nozzles. The application boom should be rotated such that the steam application is perpendicular or slightly toward the direction of sheet travel into the embossing nip.

The moisture content of the sheet after steaming can be increased by as much as 4%. In practice, the sheet rapidly reaches equilibrium moisture after steaming and embossing such that the finished product moisture is dependent on the ambient relative humidity.

With regard to the embossing step, the embossing rolls are matched rolls, such as matched steel embossing rolls. A suitable example is illustrated in U.S. Pat. No. 4,921,034 issued May 1, 1990 to Burgess et al. entitled "Embossed Paper Having Alternating High and Low Strain Regions", which is herein incorporated by reference. As used herein, the term "matched" is used loosely to mean that the male and female elements of the embossing rolls intermesh. It is not necessary that the male and female elements be identical mirror images of each other, although they can be. The embossing element heights can be any dimension typically used to engrave matched steel rolls. A preferred range of element heights can be from about 0.030 to about 0.080 inch, more preferably from about 0.045 to about 0.070 inch.

Figure 3:
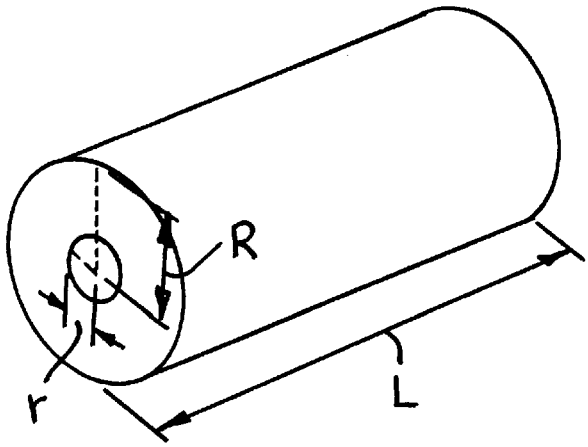
FIG. 3 is a perspective view of a roll of tissue or toweling for illustrating the calculation of roll bulk.

Referring now to FIG. 3, the calculation of roll bulk will be explained. FIG. 3 illustrates a typical roll product having a core, around which the paper product is wound. The radius of the roll product is designated as "R", whereas the radius of the core is designated as "r". The width or length of the roll is designated as "L". All measurements are expressed as "centimeters". The product roll volume "RV", expressed in cubic centimeters (cc), is the volume of the product minus the volume of the core, namely $RV=(\pi cR^2L)-(\pi r^2L)$. The product roll weight "W" is the weight of the roll minus the weight of the core, measured in grams (g). "Roll bulk", expressed in cc/g" is "RV" divided by "W".

Figure 4:
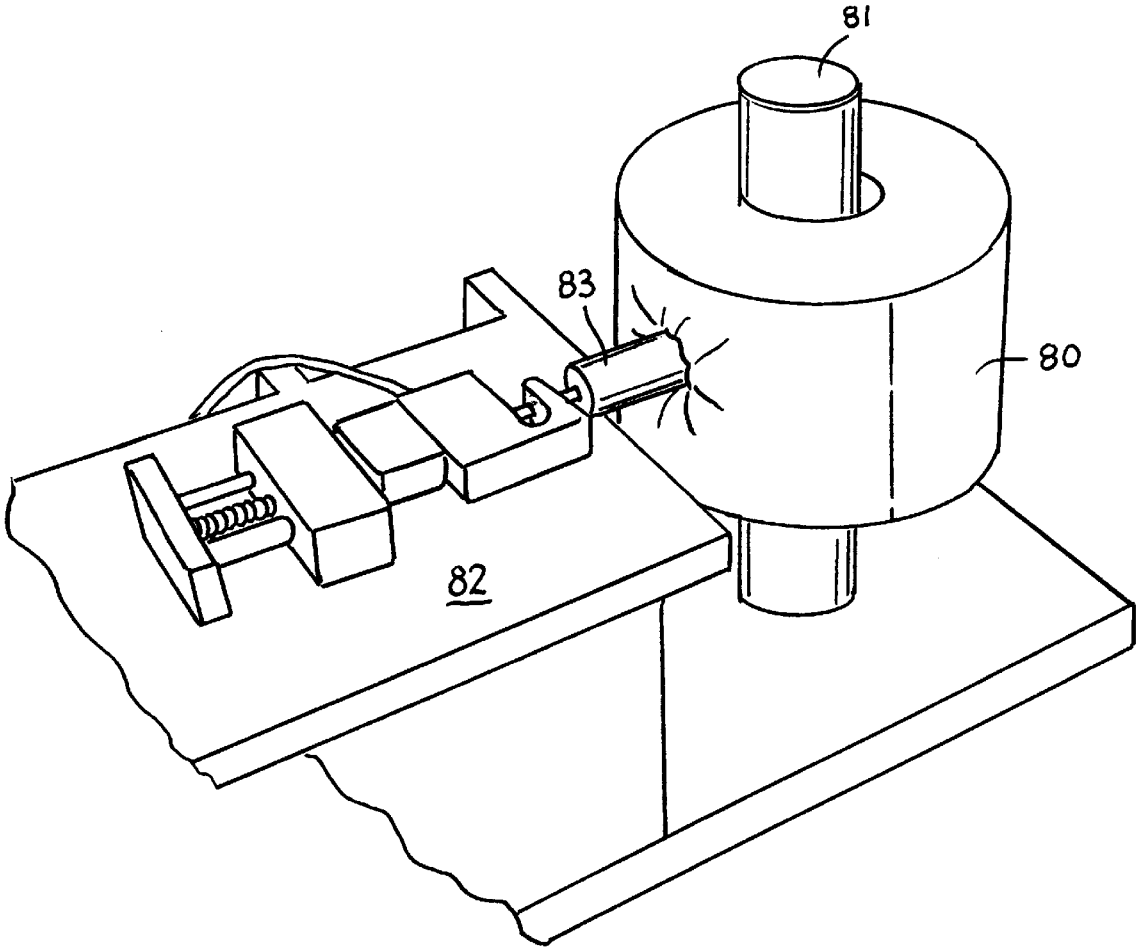
FIG. 4 is a schematic illustration of the apparatus used for determining roll firmness.

FIG. 4 illustrates the apparatus used for determining roll firmness. The apparatus is available from Kershaw Instrumentation, Inc., Swedesboro, N.J. and is known as a Model RDT-101 Roll Density Tester. Shown is a towel roll 80 being measured, which is supported on a spindle 81. When the test begins a traverse table 82 begins to move toward the roll. Mounted to the traverse table is a sensing probe 83. The motion of the traverse table causes the sensing probe to make contact with the towel roll. The instant the sensing probe contacts the roll, the force exerted on the load cell will exceed the low set point of 6 grams and the displacement display will be zeroed and begin indicating the penetration of the probe. When the force exerted on the sensing probe exceeds the high set point of 687 grams, the traverse table will stop and the displacement display will indicate the penetration in millimeters. The tester will record this reading. Next the tester will rotate the towel roll 90° on the spindle and repeat the test. The roll firmness value is the average of the two readings. The test needs to be performed in a controlled environment of 73.4±1.8° F. and 50±2% relative humidity. The rolls to be tested need to be introduced to this environment at least 4 hours before testing.

EXAMPLES

Example 1

A roll of paper toweling was made as described in relation to FIGS. 1 and 2. More specifically, a non-layered single-ply towel was made in which the furnish was comprised of 40% softwood (SW) bleached chemi-thermomechanical pulp (BCTMP) and 60% northern softwood sulfite (NSWS) slush pulp. The web was creped at a dryness between 45 and 55 percent while employing the moisturizing spray described in the above-mentioned Anderson et al. patent. Thereafter, the web was can-dried and wound into a parent roll as illustrated in FIG. 1.

Thereafter in converting, the parent roll was unwound, steamed and embossed as illustrated in FIG. 2. The steam application nozzles were spaced apart by 6 inches and employed V size nozzles from Spraying Systems. The nozzles were 1.75 inches from the sheet and the steam pressure was 1.75 psi. The nozzles applied steam in a direction perpendicular to the travel of the sheet. The steam velocity was 121 ft/min and the rate of steam application was 8500 $ft^2$ paper/lb steam.

The embossing rolls were as described in the above-mentioned Burgess et al. patent. More specifically, the embossing rolls were as described at column 5, lines 10–35 of Burgess et al.

The resulting product had a roll bulk of 13.2 cc/gm, a roll firmness of 6.88, and a CD tensile strength of 3100 grams.

Example 2

A roll of paper toweling was made as described in Example 1, except the furnish was 30% SW chemi-thermomechanical (CTMP) and 70% northern softwood sulfite (NSWS) slush pulp. The sheet was creped off of the Yankee at a dryness between 48 and 53 percent employing the moisturizing spray described in Anderson et al. In converting, the steam application nozzles were spaced apart by 6 inches and employed U size nozzles from Spraying Systems. The nozzles were 1.5 inches from the sheet and the steam pressure was 4.5 psi. The nozzles applied steam in a direction perpendicular to the travel of the sheet. The steam velocity was 366 ft/min and the rate of steam application was 3371ft2 paper/lb steam. The resulting product had a roll bulk of 15.6 cc/gm, a roll firmness of 7.7, and a CD tensile strength of 2217 grams.

Example 3

A roll of paper toweling was made as described in Example 1, except the furnish was 30% SW CTMP and 70% southern softwood kraft (SSWK) baled pulp. The sheet was creped off of the Yankee dryer at a creping dryness between 58 and 63 percent without the use of the moisturizing spray. In converting, the steam application nozzles were spaced by 6 inches and employed V size nozzles from spraying systems. The nozzles were 1.75 inches from the sheet and the steam pressure was 1.75 psi. The nozzles applied steam in a direction perpendicular to the travel of the sheet. The steam velocity was 121 ft/min and the rate of steam application was 8500$ft^2$ paper/lb steam. The resulting product had a roll bulk of 16.1 cc/gm, a roll firmness of 6.2, and a CD tensile strength of 2348 grams.

Example 4

A roll of paper toweling was made as described in Example 1, except the furnish was 100% SSWK slush pulp. The sheet was creped off of the Yankee at a creping dryness between 60 and 65 percent while employing the moisturizing spray described in Anderson et al. In converting, the steam application nozzles were spaced apart by 3 inches and employed Q size nozzles from spraying systems. The nozzles were 2.0 inches from the sheet and the steam pressure was 6.0 psi. The nozzles applied steam in a direction perpendicular to the travel of the sheet. The steam velocity was 113 ft/min and the rate of steam application was 3500 $ft^2$ paper/lb steam. The resulting product had a roll bulk of 15.76 cc/gm, a roll firmness of 7.0, and a CD tensile strength of 2565 grams.

Example 5

A roll of paper toweling was made as described in Example 1, except the furnish was 20% SW CTMP, 15% southern hardwood kraft (SHWK) slush pulp and 65% SSWK slush pulp. The creping dryness was between 55 and 65 percent and the moisturizing spray was not used. In converting, the steam application nozzles were spaced apart by 6 inches and employed V size nozzles from Spraying Systems. The nozzles were 1.75 inches from the sheet and the steam pressure was 1.75 psi. The nozzles applied steam in a direction perpendicular to the travel of the sheet. The steam velocity was 121 ft/min and the rate of steam application was 8500 ft2 paper/ lb steam. The resulting product had a roll bulk of 15.1 cc/gm, a roll firmness of 7.4, and a CD tensile strength of 3179 grams.

Example 6

A roll of paper toweling was made as described in Example 1, except the furnish was 15% SHWK slush pulp and 85% SSWK slush pulp. The creping dryness was between 55 and 65 percent and the moisturizing spray was not used. In converting, the steam application nozzles were spaced apart by 6 inches and employed V size nozzles from Spraying Systems. The nozzles were 1.75 inches from the sheet and the steam pressure was 1.75 psi. The nozzles applied steam in a direction perpendicular to the travel of the sheet. The steam velocity was 121 ft/min and the rate of steam application was 8500 $ft^2$ paper/lb steam. The resulting product had a roll bulk of 15.5 cc/gm, a roll firmness of 6.5, and a CD tensile strength of 2827 grams.

Example 7

A roll of paper toweling was made as described in Example 1, except the furnish was 30% SW CTMP, 15% SSWK baled pulp and 55% SSWK wet lap pulp. The creping dryness was between 58 and 65 percent. The moisturizing spray was not used. In converting, the steam application nozzles were spaced apart by 6 inches and employed U size nozzles from Spraying Systems. The nozzles were 1.5 inches from the sheet and the steam pressure was 6.5 psi. The nozzles applied steam in a direction perpendicular to the travel of the sheet. The steam velocity was 470 ft/min and the rate of steam application was 2460 ft2 paper/lb steam. The resulting product had a roll bulk of 16.2 cc/gm, a roll firmness of 7.7, and a CD tensile strength of 2041 grams.

Examples 8–13

The roll bulk, roll firmness and CD tensile strength of six different brands of commercial kitchen towel products were measured. The results are set forth in the Table below:

TABLE (Commercial Products)

| Product | Roll Bulk | Roll Firmness | CD Tensile |
|---|---|---|---|
| Brawny ® | 12.39 | 10.08 | 2425 |
| Mardi Gras ® | 12.66 | 6.67 | 2185 |
| Scott ® Towels | 13.04 | 13.58 | 982 |
| Sparkle ® | 13.44 | 10.15 | 2325 |
| Bounty ® | 16.07 | 11.62 | 2208 |
| Hi-Dri ® | 18.16 | 13.63 | 1123 |

Figure 5:
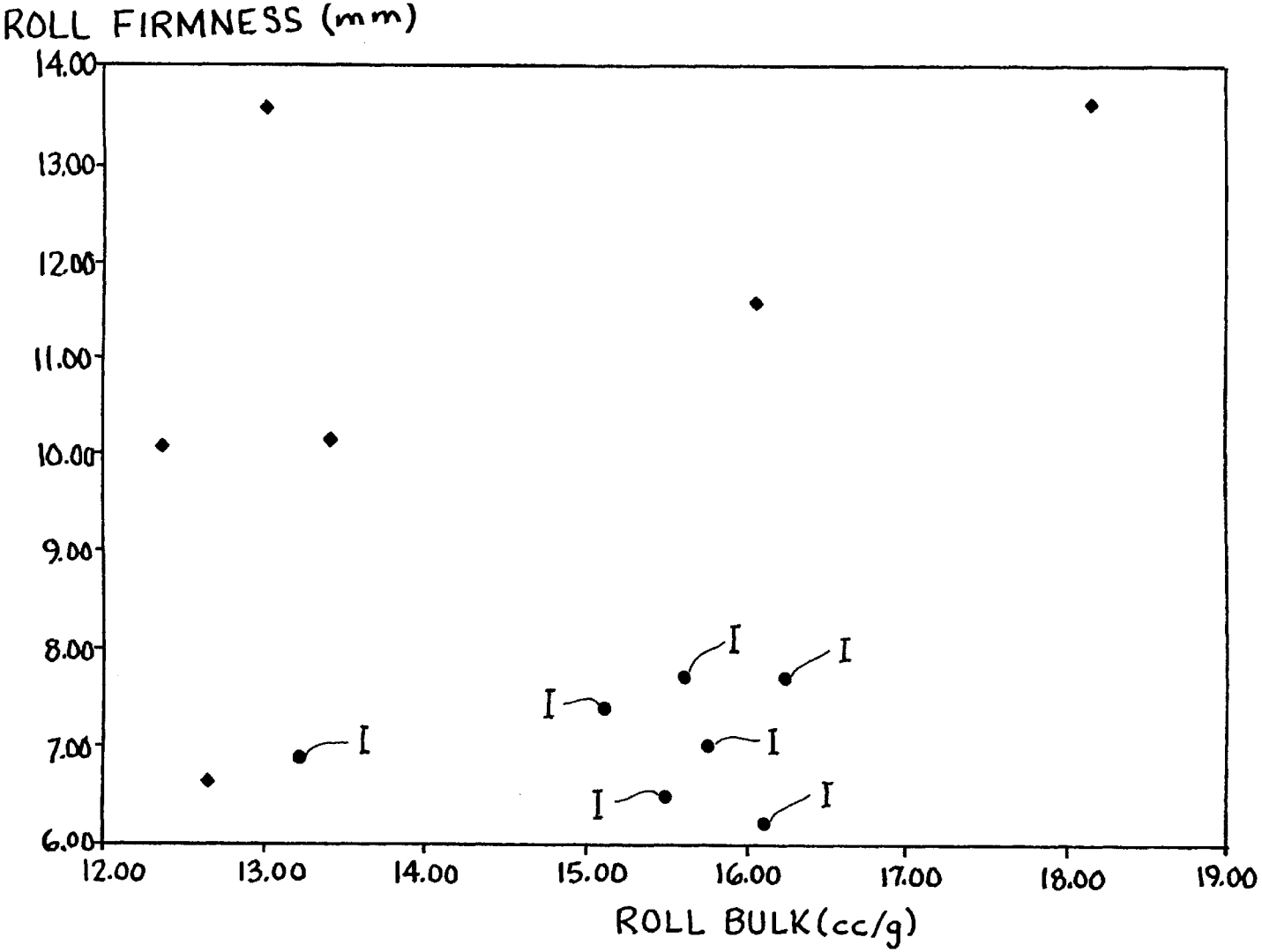
FIG. 5 is a plot of roll bulk and roll firmness for several commercial paper towel products and the examples of products made in accordance with this invention.

Referring to FIG. 5, the roll bulk and the roll firmness for the products of this invention described in the Examples (labelled "I") and the commercial products identified above are plotted. As shown, the products of this invention are unique in their properties by having a high bulk and a high degree of roll firmness.

It will be appreciated that the foregoing examples, given for purposes of illustration, are not to be construed as limiting the scope of this invention, which is defined by the following claims and all equivalents thereto.

We claim:

1. A roll of single-ply creped paper having a roll bulk of 13 cubic centimeters per gram (cc/g) or greater, a roll firmness of 10 millimeters (mm) or less and a cross-machine direction (CD) tensile strength of about 2000 or greater grams per 3 inches of width (grams).

2. The roll of claim 1 having a roll bulk of 15 cc/g or greater.

3. The roll of claim 1 having a roll bulk of 16 cc/g or greater.

4. The roll of claim 1 having a roll bulk of from about 14 to about 20 cc/g.

5. The roll of claim 1 having a roll bulk of from about 15 to about 17 cc/g.

6. The roll of claim 1 having a roll firmness of about 9 mm or less.

7. The roll of claim 1 having a roll firmness of from about 6 to about 10 mm.

8. The roll of claim 1 having a roll firmness of from about 7 to about 9 mm.

9. The roll of claim 1 having a CD tensile strength of about 2500 grams or greater.

10. The roll of claim 1 having a CD tensile strength of from about 2200 to about 3500 grams.

11. The roll of claim 1 having a CD tensile strength of from about 2300 to about 3200 grams.

12. A roll of creped paper having a roll bulk of 13 cubic centimeters per gram (cc/g) or greater, a roll firmness of from about 6 to about 7.7 millimeters and a cross-machine direction (CD) tensile strength of about 2000 or greater grams per 3 inches of width (grams).

13. The roll of claim 12 having a roll bulk of 15 cc/g or greater.

14. The roll of claim 12 having a roll bulk of 16 cc/g or greater.

15. The roll of claim 12 having a roll bulk of from about 14 to about 20 cc/g.

16. The roll of claim 12 having a roll bulk of from about 15 to about 17 cc/g.

17. The roll of claim 12 having a CD tensile strength of about 2500 grams or greater.

18. The roll of claim 12 having a CD tensile strength of from about 2200 to about 3500 grams.

19. The roll of claim 12 having a CD tensile strength of from about 2300 to about 3200 grams.

* * * * *